US008647481B2

(12) United States Patent
Wattel et al.

(10) Patent No.: US 8,647,481 B2
(45) Date of Patent: Feb. 11, 2014

(54) POT TENDING MACHINE FOR WORKING ON ELECTROLYSIS CELLS FOR THE PRODUCTION OF ALUMINUM BY IGNEOUS ELECTROLYSIS

(75) Inventors: Arnaud Wattel, Tourcoing (FR); Stéphane David, Lomme (FR)

(73) Assignee: E.C.L., Ronchin (FR)

( * ) Notice: Subject to any disclaimer, the term of this patent is extended or adjusted under 35 U.S.C. 154(b) by 357 days.

(21) Appl. No.: 13/122,919

(22) PCT Filed: Sep. 15, 2009

(86) PCT No.: PCT/FR2009/001095
§ 371 (c)(1),
(2), (4) Date: Apr. 6, 2011

(87) PCT Pub. No.: WO2010/031919

PCT Pub. Date: Mar. 25, 2010

(65) Prior Publication Data

US 2011/0194916 A1 Aug. 11, 2011

(30) Foreign Application Priority Data

Oct. 16, 2008 (FR) ..... 08 05719

(51) Int. Cl.
*C25C 7/00* (2006.01)
*C25C 3/06* (2006.01)

(52) U.S. Cl.
USPC ... 204/245; 204/279; 204/286.1; 204/297.01; 204/243.1; 205/389; 205/392

(58) Field of Classification Search
USPC ..... 204/245, 247, 279; 205/389, 392
See application file for complete search history.

(56) References Cited

U.S. PATENT DOCUMENTS 3,567,206 A 3/1971 Heggstad
3,627,670 A 12/1971 Duclaux (Continued)

FOREIGN PATENT DOCUMENTS

JP 03294754 A 12/1991
SU 981457 12/1982
SU 1522786 10/1996
WO 03014646 A1 2/2003

OTHER PUBLICATIONS

Plant Services, Compressors—Compressed Air Systems; 2005-2006 collection; p. 1-59 (http://www.putman.net/brands/ps/downloads/ps_compressed_air_articles.pdf).*

(Continued)

*Primary Examiner* — Harry D Wilkins, III
*Assistant Examiner* — Zulmariam Mendez
(74) *Attorney, Agent, or Firm* — Banner & Witcoff, Ltd.

(57) ABSTRACT

Pot tending machine for a series of electrolysis cells designed for the production of aluminum by igneous electrolysis including:

a) an overhead traveling crane which can be relocated above said electrolysis cells, b) a tool carriage onto which is fixed a service module comprising tools;

c) a tapping winch, interdependent of said overhead traveling crane, designed to grasp and position near cell a tapping assembly including a ladle, a tapping tube and a vacuum device;

d) a freestanding device able to generate compressed air; characterized in that said compressed air generating device of includes a first compressor, able to provide a flow of compressed air at least equal to the minimum air flow necessary for operations other than tapping, and at least one second compressor mounted in such a way that, when operating simultaneously with said first compressor, the unit provides a flow of compressed air at least equal to the minimum output of air necessary during tapping.

13 Claims, 1 Drawing Sheet

(56) References Cited

U.S. PATENT DOCUMENTS

| | | | | |
|---|---|---|---|---|
| 4,742,994 | A | 5/1988 | Zannini et al. | |
| 5,435,897 | A * | 7/1995 | Zannini | 204/245 |
| 6,153,066 | A * | 11/2000 | Piron | 204/245 |
| 7,422,675 | B2 * | 9/2008 | Acker et al. | 205/389 |
| 2005/0211552 | A1 | 9/2005 | Acker | |
| 2006/0086607 | A1 * | 4/2006 | Duval | 204/194 |
| 2006/0290153 | A1 * | 12/2006 | Delescluse | 294/115 |

OTHER PUBLICATIONS

International Search Report and Written Opinion mailed Dec. 17, 2009 (PCT/FR2009/001095); ISA/EP.

French Search Report completed Jun. 24, 2009 (FR08 05719); SA/EP.

* cited by examiner

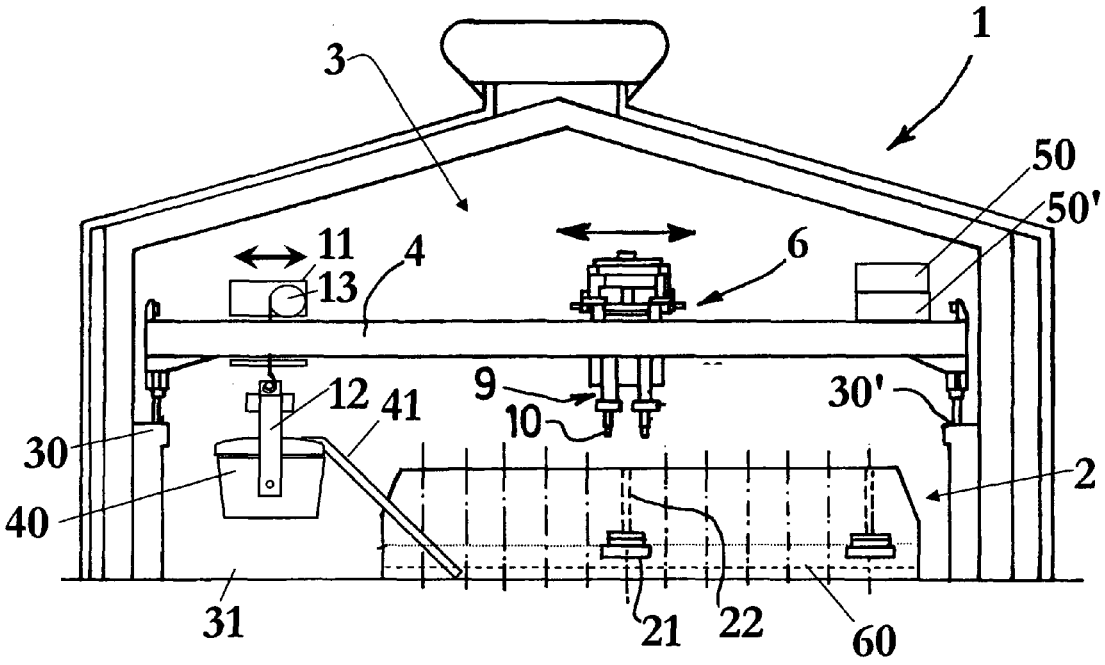
Figure

POT TENDING MACHINE FOR WORKING ON ELECTROLYSIS CELLS FOR THE PRODUCTION OF ALUMINUM BY IGNEOUS ELECTROLYSIS

CROSS-REFERENCE TO RELATED APPLICATIONS

The present application is a U.S. National Phase filing of International Application No. PCT/FR2009/001095 filed on Sep. 15, 2009, designating the United States of America and claiming priority to French Patent Application No. FR 08 05719, filed on Oct. 16, 2008, both of which applications the present application claims priority to and the benefit of, and both of which applications are incorporated by reference herein in their entireties.

The invention relates to aluminum production using igneous electrolysis by means of the Hall-Héroult process. It more particularly relates to pot tending machines used in aluminum production plants.

Aluminum is produced industrially by igneous electrolysis, using the well-known Hall-Héroult process, in electrolysis cells. The plants contain a great number of electrolysis cells laid out in line, in buildings called potrooms, and electrically connected in series using connecting conductors, in order to make the best use of the floor area of the plants. The cells are generally laid out so as to form two or more parallel lines which are electrically linked to each other by end conductors.

When operating, an electrolysis plant requires work on the electrolysis cells, including replacement of worn anodes by new ones, sampling of molten metal produced in the cells and sampling or top-ups of electrolyte. In order to carry out this work, plants are generally equipped with one or more service units including an overhead traveling crane which can be relocated above the electrolysis cells, along series of cells, and one or more service modules including a carriage able to be moved on the overhead traveling crane, and handling and servicing devices called "tools", such as shovels, grips, tappers and hoists. These service units are often called "Pot Tending Assemblies" (PTA) or "Pot Tending Machines" (PTM).

The pot tending machines are primarily equipped with the tools necessary for anode replacement (tappers, anode grips (also called "anode wrenches"), bucket shovels, etc.) which are in general grouped together on a turret fixed onto the carriage, called a "tool carriage". They are brought to the work area on the tank by movements of the crane and the tool carriage, and are then taken down to the level of said work area using cables actuated by winches or using telescopic arms or booms actuated by hydraulic or pneumatic cylinders. These tools are themselves generally actuated pneumatically or hydraulically.

Often, the pot tending machines are also equipped with a device designed to extract the aluminum produced in the tanks. The metal produced in the electrolysis cell is regularly extracted from the tank by plunging the end of a hollow metal tube, generally made of cast iron, into the molten layer of metal, which connects said layer of molten metal to a ladle while passing through the electrolyte bath. The ladle is leak-tight, typically made of steel and lined with refractory bricks. A partial vacuum is applied in the interior volume of the ladle, which attracts the molten metal produced in the tank, the latter running out through the tube towards the ladle where it is collected. The partial vacuum is created in the atmosphere of the ladle using a vacuum device, typically a vacuum ejector pump controlled by compressed air, in which the compressed air enters and leaves the pump at high speed creating a drop in pressure in the external surrounding space by means of the Venturi effect. During the tapping operation, the partial vacuum in the ladle requires a large amount of compressed air.

To carry out the tapping operation, independent devices can be used, such as a vehicle on the ground dedicated to this task, like those illustrated in patent U.S. Pat. No. 4,742,994 and in FIG. 1 of the international request WO03/014.646, or a special crane equipped with a particular kind of ladle, such as that illustrated in FIGS. 7 and 8 of WO03/014646. But, more advantageously, an existing device can be used, such as the pot tending machine used elsewhere for the various anode replacement operations. A hoist, also called a "tapping winch", is fitted either onto the turret fixed to the tool carriage, or fitted to another mobile carriage moving on the overhead traveling crane of the pot tending machine, or fixed to a particular part of the gantry. The tapping winch is typically provided with a lifting hook designed to grasp the ladle. It is advantageous to group together the ladle, the tapping tube and the vacuum device designed to produce partial vacuum in the ladle. The tapping assembly obtained in this way can be attached to a swing bar, for example by providing said swing bar with lifting lugs on which the ladle is hung, already provided with the tapping tube and the vacuum device. In this way, via said swing bar, the tapping assembly can be grasped quickly by the tapping winch, and the downtime of the pot tending machine is cut down to the time required for fixing the swing bar and for making the various electric and pneumatic connections necessary for the tapping assembly to operate properly.

The compressed air required to create the partial vacuum in the ladle can be provided by a fixed air intake in the building, typically the air intake nearest to the cell on which tapping is carried out, but it can also be provided by the compressed air source of the pot tending machine. In both cases, when a tapping operation is started, a tapping assembly is procured, typically attached to a swing bar; it is suspended from the tapping winch and the pneumatic and electric connections are made to handle the operations necessary during tapping, typically by using the button box which controls the pot tending machine. A ladle is designed so that it can collect the melt from several tanks. In general, ladles of today can collect liquid aluminum coming from casts made in three cells. As these cells are not necessarily close to each other, it is preferred to connect the ladle to the source of compressed air of the pot tending machine once only, using short and light cables and hoses suitable for the stable and known space configuration of the PTA, rather than connecting the ladle to several fixed sources, external to the pot tending machine, each time choosing the one that is closest to the cell in which tapping is to be carried out, the unpredictable nature of the connections to be made requiring the use of long and heavy cables and hoses.

It is however to be observed that pot tending machines adapted to this latter way of operating have the disadvantage of consuming great amounts of energy and requiring much maintenance work. The applicant therefore sought to develop a pot tending machine that consumes as little energy as possible and requiring as low a frequency of maintenance work as possible, while being perfectly suited for both anode replacement and tapping operations.

A first object according to the invention is a pot tending machine for a series of electrolysis cells designed for the production of aluminum by igneous electrolysis including:

a) an overhead traveling crane which can be relocated above the electrolysis cells, b) a tool carriage, which moves along said overhead traveling crane and on which is fixed a service module including handling and servicing parts, referred to as "tools", c) a tapping winch, interdependent of said overhead traveling crane, designed to grasp and position near the tank a tapping assembly including a ladle, a tapping tube and a vacuum device designed to create a partial vacuum in said ladle, in order to suck the liquid aluminum through said tapping tube and pour it into said ladle;

d) a freestanding device able to generate compressed air, in order to actuate said tools and said vacuum device.

Said pot tending machine is characterized in that said compressed air generating device includes a first compressor, able to provide a flow of compressed air at least equal to the minimum air flow necessary for uses of the pot tending machine other than for tapping, the air being compressed to the required pressure p, and at least one second compressor fitted to the pneumatic circuit of said pot tending machine so that while operating simultaneously with said first compressor the unit provides a flow of compressed air at least equal to the minimum output of air necessary during tapping, compressed to pressure p' which makes it possible to create the partial vacuum targeted within the ladle.

The applicant started out from the observation that, on pot tending machines designed to independently carry out both anode replacement and tapping operations, the compressed air preparation units were expensive and required a large amount of maintenance because they were equipped with a high-power on-board compressor. The applicant realized that this high-power compressor was designed according to the compressed air flow requirement for tapping operations, which is in fact much higher than the air flow requirement for most other operations, in particular those corresponding to anode replacement, where the actuation of handling and servicing tools consumes significantly less compressed air.

The applicant, noting that the "tapping" function was used for only approximately a quarter of the operating time of the pot tending machine, concluded that the on-board high-power compressor, designed for the tapping operation, was operating very much below capacity for 75% of the time that it was in use. Moreover, using it at a lower output not only led to unnecessary energy consumption but also unnecessarily deteriorated the properties of the lubrication oils, causing practically as much wear to the mechanical components as if the compressor had run at full capacity for 100% of the time that it was in use. On the basis of this observation, the applicant had the idea of fitting to the pot tending machine, in place of a large, cumbersome compressor that used a lot of energy even at low power, at least two lower capacity compressors: a first compressor designed for operations other than tapping, and at least one second compressor designed to provide the extra compressed air necessary during tapping.

The pot tending machine was initially designed to carry out the operations necessary for anode replacement. A single compressor, with a regular capacity compatible with the standards of the market, is enough to perform the functions related to these operations as well as certain permanent functions that do not consume great amounts of compressed air. The functions related to anode replacement operations are primarily:

a) actuating a tapper, to destroy the crust at the level of the worn anode to be replaced, removing the connector;

b) moving the wrench associated with the connector which provides contact between the anode rod and the anode framework (opens during removal of the used anode, closes during fitting of the new anode);

c) actuating the anode grip, also called the "anode wrench";

d) actuating the shovels of the crust breaker used to collect the solid remains in the bath at the level of the anode hole.

In addition, for the PTA to operate properly, it must be possible for certain functions that do not use much compressed air to be carried out at any time, for example turning on the blow guns on the rollers, spraying the condensates in the air-conditioning system, unlocking the downward movement of the cabin, etc.

Other functions, which we will hereafter indicate as "complementary functions", can be assigned to the PTA, in particular functions also related to anode replacement but which may also be carried out independently:

removing and refitting the hoods of the hooding device which makes it possible to confine, collect and treat effluents from the electrolysis cell before they are released into the atmosphere;

performing an operation known as "gauging", designed to properly level new anodes In addition, as part of these complementary functions, optional functions that consume more compressed air can be assigned to the PTA, in particular to fluidize the alumina or aluminum fluoride in the feed hoppers or to actuate the anode framework lifting mechanism.

To carry out all the functions allotted to the PTA, as the number of complementary functions keeps increasing because of the attractiveness of this type of device, the second compressor recommended according to the invention may be used as soon as the need for compressed air exceeds a critical threshold. But as these complementary functions require less compressed air than the tapping operation, it may prove to be advantageous to install several "second compressors", so that they run together only for the tapping operation, a smaller number being sufficient to carry out any one of these complementary functions. In addition, the term "tapping operation" must be taken to indicate the operation performed using the PTA which requires the most compressed air. It may therefore be that in the future this term may indicate an operation other than tapping itself.

Advantageously, the ladle, the tapping tube, and the vacuum device are grouped together and the tapping assembly formed in this way is attached to a swing bar, designed to be grasped by the tapping winch. Advantageously, the electric cables, pneumatic hoses, distributors, electrically-operated valves and/or various other means used for turning on the vacuum device for tapping, are grouped together with the tapping assembly interdependent of the swing bar and arranged so that electric and pneumatic connections required to make the tapping assembly operational are simple and quick.

In general, the air used to operate the tools is compressed to the usual industrial facility pressure p, typically ranging between 6 and 10 bar, i.e. between 0.6 and 1.0 MPa. In general, the first compressor must be able to provide compressed air at a minimal output typically ranging between 4000 normal liters and 7500 normal liters per minute, depending on the number of tools of the PTA to be actuated, at a pressure of 0.6 MPa, and the second compressor(s) must be able to provide the top-up when tapping (an output of one normal liter per minute of gas corresponds to the flow, per minute, of a mass of gas occupying the volume of one liter in normal conditions of pressure and temperature).

For the tapping operation, the compressed air must be provided at a flow rate and pressure p' such that the negative pressure created by the Venturi effect at the level of the ejector is high enough for the liquid aluminum to be sucked in and transported to the ladle but low enough to avoid entraining any of the electrolyte bath along with the liquid aluminum. Typically, for a ladle able to take approximately 5 tons of liquid aluminum, a partial vacuum of about 0.04 MPa requires a minimum flow of at least 10 000 normal liters per minute of compressed air at a pressure of 0.6 MPa. During tapping, the flow and the compressed air pressure must not remain constant because they must generate a partial vacuum adapted to the stage which the tapping operation has reached: a completely empty ladle requires a much larger consumption of compressed air than a ladle already filled with the melt from the first two cells. The applicant found that it was possible to choose a vacuum device meeting all these requirements with compressed air at a pressure p' ranging between 6 and 10 bar, i.e. between 0.6 and 1.0 MPa, preferably ranging between 0.6 and 0.8 MPa. Preferably, a first compressor should be chosen that is able to provide compressed air with a minimum output of 6 500 normal liters at a pressure ranging between 0.6 MPa and 0.8 MPa, and one or more second compressors able to provide compressed air at a minimum output of 13 000 normal liters at a pressure ranging between 0.6 MPa and 1.0 MPa, preferably between 0.6 MPa and 0.8 MPa, while operating simultaneously with the first compressor.

In a preferred method of the invention, the first compressor and the second compressor are used so that they operate in tandem:

- either they function independently of each other, each compressor being able to provide the working air flow during use phases of the PTA other than tapping,
- or they operate together, the sum of the flows being able to meet the needs for the creation of a partial vacuum in the ladle during tapping.

If several second compressors are used, at least one of them functions in tandem with the first compressor.

In this preferred method, the two compressors are interchangeable and it is advantageous for them to be identical. "Identical" here means "able to provide the same minimum flow of compressed air at the same pressure". So during normal use phases either one of the compressors can be made to operate, preferably alternatively with the other in order to distribute the operating time between the two compressors in a substantially equal manner, with the result that the time between two servicing operations could be substantially increased, to almost double, if there were no tapping. The result, since both compressors are used during the tapping phases, and all other things being considered to be substantially equal, is that the time between two servicing operations on all the compressors is higher by about 60% than the time between two servicing operations on only one high-power compressor. The reduction in servicing frequency not only leads to a reduction in the number of times the compressor has to be drained for continued efficient performance, a fall in oil consumption, and a saving in terms of staff downtime, but also improves the availability of the pot tending machine, so that an electrolysis hall could, for a given set of functions, be equipped with a smaller number of pot tending machines, if these meet with the characteristics of the invention. But the current trend would be rather to keep the same number and assign additional functions to them.

The compressors used within the context of the invention are smaller in comparison to what would be necessary if a single compressor were used. Thanks to the invention, compressors can be used which correspond to the standards of the market, and which have a relatively lower acquisition cost owing to the fact that they are produced in large quantities. It follows that the cost of installing several compressors is not any higher overall than that of a single large-size compressor. Moreover, as the compressors are chosen from market standards, it is easier to obtain spare parts and maintenance is greatly facilitated because of this. The result is that maintenance and operating costs are lower, while capital expenditures remain similar.

Another advantage of the invention lies in the fact that the availability of pot tending machines (PTA) for operations other than tapping can be greatly improved: in the event of breakdown of the one of the compressors, at least one other compressor can be made to operate, in particular during anode replacement.

The overhead traveling crane of the pot tending machine rests and circulates on gantry tracks laid out in parallel with each other and with the main axis of the hall (and of the line of cells).

The overhead traveling crane can therefore be moved along the electrolysis hall, above the cells, in general remaining parallel to the longer side of the cells.

The swing bar, equipped with said tapping assembly, is fixed to the tapping winch which is itself either interdependent of the tool-holder turret of the PTA, or interdependent with another mobile carriage running on said overhead traveling crane, or fixed to a part of said overhead traveling crane. Preferably, the tapping winch is interdependent of a mobile carriage so that it can be put in the best possible position, such that the ladle can freely reach a position which, without blocking the movement of the tool carriage, allows the tapping tube to plunge into the liquid aluminum bath, at the level of the tapping hole, generally located at one end of the electrolysis cell.

Preferably, the compressed air generating device, including at least two compressors, is interdependent of the overhead traveling crane and is placed upon it. It is typically fixed directly to the main beam of said overhead traveling crane, either inside it or above it, outside the working area of the mobile carriages.

Advantageously, the first compressor and the second compressor(s) are installed on the beam of the overhead traveling crane in order to obtain a compact and inexpensive layout, in particular by aiming for the lowest possible spatial requirement at the level of the fastener to the beam. Preferably, the compressors are stacked one above the other.

Preferably, the compressors are provided with either an individual or common cooling system. Compared to an installation comprising only one high-power compressor, cooling possibilities are greater, when expressed as a unit of air flow produced. This results in more efficient cooling systems.

Preferably also, the compressors are provided with a filtration system, either individual or common, to keep them free from dust, particularly solid particles of alumina and carbon. Advantageously, they are installed in an on-board enclosure, either individual, or common, with acoustic insulation and equipped with a system of temperature control to maintain said compressors in an environment in keeping with efficient performance from the temperature standpoint The pot tending machine must be able to move above the electrolysis cells in a hostile environment, at a temperature that may, depending on the aluminum production site, be very low (about −30° C.) or very high (about 70° C.). Said on-board enclosure may, for example, be a structure equipped with removable external panels providing leak-tightness and sound protection for the unit.

EXAMPLE OF EMBODIMENT (FIGURE)

The FIGURE illustrates a cross-sectional view of a typical electrolysis hall, designed for the production of aluminum and comprising a particular embodiment of the pot tending machine according to the invention, shown schematically.

Electrolysis plants for the production of aluminum include a liquid aluminum production area containing one or more electrolysis halls. The electrolysis hall (1) illustrated in the FIGURE comprises electrolysis cells (2) above which a pot tending machine (3) circulates. The electrolysis cells (2) are normally laid out in row or files, each row or file typically comprising over a hundred cells. The cells (2) are laid out so as to leave an aisle (31) throughout the length of the electrolysis hall (1). Cells (2) include a series of anodes (21) provided with a metal rod (22) for fixing the anodes and connecting them electrically to a metal anode frame (not shown).

The pot tending machine (3) is used to carry out operations on the cells (2) such as changing anodes or filling the feed hoppers with crushed melt and aluminum fluoride (AlF3). It can be also used to handle various loads, such as tank parts, ladles of melt or anodes. The invention relates particularly to the service units designed for both anode changing and melts.

The pot tending machine (3) comprises:

an overhead traveling crane (4) which can be relocated above the electrolysis cells (2), a mobile carriage (6), known as "tool holder", designed to be moved on the overhead traveling crane(4) and equipped with several handling and service parts (10), such as tools (shovels, anode grips (anode wrenches), tappers, etc);

a tapping winch (13) assembled on a carriage (11), able to be moved on the overhead traveling crane (4) to which is attached a swing bar (12) which carries a tapping assembly including a ladle (40), a tapping tube (41) and a vacuum device (not shown);

a freestanding device able to generate compressed air, including, in this example, two identical compressors (50 and 50'), each compressor being able to provide a flow of compressed air of at least 8 000 normal liters per minute, at a pressure ranging between 7 and 10 bar, which corresponds to the air flow required for using the pot tending machine for operations other than tapping, both compressors being fitted so that when they operate in tandem, they provide a compressed air flow of 16 000 normal liters per minute, at a pressure ranging between 7 and 10 bar, corresponding to the minimum flow necessary to perform the tapping operation.

The overhead traveling crane (4) rests and circulates on gantry tracks (30, 30') laid out in parallel with each other and with the main axis of the hall (and the line of cells). The overhead traveling crane (4) can thus be moved along the electrolysis hall (1).

The tool carriage (6) supports a service module which comprises a frame, not shown, able to be fixed to said carriage, and a turret mounted on the frame so as to be able to swivel around a vertical working axis. The turret may be equipped with a balcony or a control cabin—comprising orders designed to operate the service module and said tools—and a control station from which an operator can actuate said orders.

The turret is equipped with a given set of tools (10), namely a tapper mounted on a telescopic arm (9), a mechanical shovel mounted on a telescopic arm, at least one anode handling grip also mounted on a telescopic arm, and a hopper provided with a retractable conduit. These tools are designed for anode changing operations on the electrolysis cells in the hall the tapper is used to break the alumina crust and solidified melt which generally covers the anodes of the cell;

the mechanical shovel is used to clear the location of the anode, once the used anode has been withdrawn, by removing the solid matter (such as pieces of crust, carbon and alumina) which are there;

the anode handling grip(s) is/are used to grasp and handle the anodes by their rod, in particular for removing worn anodes from an electrolysis cell and fitting new anodes in the electrolysis cell;

the retractable conduit is used to introduce alumina and/or crushed melt into the electrolysis cell, so as to form a new layer of coating, after a new anode has been fitted.

The turret can also be equipped with additional tools, such as a hoist. All these tools are actuated using compressed air, at 6 approximately bar, from one of the compressors (50, 50').

The metal produced in the electrolysis cell (2), the highest level of which is shown by the dotted line (60) is extracted from the tank by introducing one end of the tapping tube (41) into the layer of molten metal. The tapping tube, which is a hollow metal tube, is connected to the ladle (40). A partial vacuum is applied in the interior volume of the ladle, which attracts the molten metal produced in the tank, the latter running out through the tube towards the ladle where it is collected. The partial vacuum is created in the atmosphere of the ladle (40) using a vacuum ejector pump powered by compressed air at approximately 6 bar from the two compressors (50 and 50') operating together during tapping.

The two compressors (50, 50') are installed one above the other, to reduce the space required for fastening them onto the main beam of the overhead traveling crane (4). Each compressor is provided with a cooling system and a filtration system. Each compressor is provided with a motor with a rated output of 55 kW.

To carry out the same functions as this PTA, a PTA according to prior art must be equipped with a compressor with a rated power level of 110 kW. The frequency of servicing operations on the former PTA is determined by the draining of the single compressor. Draining must be performed every 1500 hours. With the PTA according to the invention, the time between two servicing operations for the twin compressor is about 2400 hours.

Given that a PTA is operational 24 hours a day and 7 days a week all year round, this PTA must, taking into account inevitable outages for maintenance, be operational on site approximately 6400 hours per year. The maintenance frequency for a PTA equipped with a single compressor therefore requires it to be taken out of operation 4.3 times per year. In contrast, according to the invention, the time between two servicing operations for a PTA equipped with the twin compressor requires this PTA to be taken out of operation 2.7 times per year. Therefore, according to the invention, the PTA equipped with a twin compressor makes it possible to gain three servicing operations every two years, which significantly improves its availability time, and makes it possible to reduce the costs generated by this type of work (parts, labor, etc.).

The invention claimed is:

1. Pot tending machine for a series of electrolysis cells designed for the production of aluminum by igneous electrolysis including:

a) an overhead traveling crane which can be relocated above said electrolysis cells, b) a tool carriage, which moves along said overhead traveling crane and on which is fixed a service module including tools;

c) a tapping winch, interdependent of said overhead traveling crane, designed to grasp and position near to cell a tapping assembly including a ladle, a tapping tube and a vacuum device designed to create a partial vacuum in said ladle, in order to suck the liquid aluminum through said tapping tube and pour it into said ladle;

d) a freestanding device able to generate compressed air, in order to actuate said tools and said vacuum device;

characterized in that said compressed air generating device includes a first compressor, able to provide a flow of compressed air at least equal to a minimum air flow necessary for uses of the pot tending machine other than for tapping, the air being compressed to a required pressure p, and at least one second compressor fitted to a pneumatic circuit of said pot tending machine so that while operating simultaneously with said first compressor the unit provides a flow of compressed air at least equal to a minimum output of air necessary during tapping, compressed to pressure p' which makes it possible to create the partial vacuum targeted within the ladle.

2. Pot tending machine according to claim 1 characterized in that said first compressor is able to provide compressed air at a minimum flow of 4000 normal liters, at a pressure ranging between 0.6 MPa and 1.0 MPa and said at least one second compressor is able to provide, while functioning simultaneously with said first compressor, compressed air at a minimum flow of 10000 normal liters, at a pressure ranging between 0.6 MPa and 1.0 MPa.

3. Pot tending machine according to claim 1, characterized in that said compressed air generating device consists of a first compressor and of at least one second compressor operating in tandem with said first compressor, wherein said first compressor and said at least one second compressor either function independently of each other, each compressor being able to provide a working air flow during phases of use of the pot tending machine other than for tapping, or operate together, the sum of the air flows being sufficient to meet the needs for the creation of a partial vacuum in the ladle, during tapping.

4. Pot tending machine according to claim 3 characterized in that said first compressor and said at least one second compressor are identical.

5. Pot tending machine according to claim 1, in which said tapping winch is interdependent of the tool carriage.

6. Pot tending machine according to claim 1, in which said tapping winch is interdependent of a mobile carriage circulating on said overhead traveling crane, distinct from said tool carriage.

7. Pot tending machine according to claim 6, in which the compressed air generating device is interdependent of said overhead traveling crane and is placed upon said overhead traveling crane and fixed directly onto the a main beam of said overhead traveling crane, either inside it, or above, outside from a working area of said mobile carriage(s).

8. Pot tending machine according to claim 7 in which said first and second compressors are stacked one above the other, to reduce space required for fastening the first and second compressors onto said beam.

9. Pot tending machine according to claim 1, in which said first and second compressors are provided with a cooling system.

10. Pot tending machine according to claim 1, in which said first and second compressors are provided with a filtration system.

11. Pot tending machine according to claim 1, in which said first and second compressors are installed in an on-board enclosure, either individual, or common, with acoustic insulation and equipped with a system of temperature control to maintain said compressors in an environment in keeping with efficient performance from the temperature standpoint.

12. Pot tending machine according to claim 2, wherein said first compressor is able to provide compressed air at a minimum flow of 6500 normal liters.

13. Pot tending machine according to claim 2, wherein said at least one second compressor is able to provide, while functioning simultaneously with said first compressor, compressed air at a minimum flow of 13000 normal liters, at a pressure ranging between 0.6 MPa and 0.8 MPa.

* * * * *